United States Patent [19]

Papesh

[11] Patent Number: 4,573,337

[45] Date of Patent: Mar. 4, 1986

[54] FRAME TO HOLD AUTO BODIES FOR STRAIGHTENING

[76] Inventor: Thomas S. Papesh, 1915 N. Broadway, Crest Hill, Ill. 60435

[21] Appl. No.: 660,820

[22] Filed: Oct. 15, 1984

[51] Int. Cl.[4] ..... B21D 1/12

[52] U.S. Cl. ..... 72/305; 72/705

[58] Field of Search ..... 72/705, 305

[56] References Cited

U.S. PATENT DOCUMENTS

| | | | |
|---|---|---|---|
| 4,067,222 | 1/1978 | Eck | 72/705 |
| 4,238,951 | 12/1980 | Grainger et al. | 72/705 |
| 4,404,838 | 9/1983 | Hare | 72/705 |

*Primary Examiner*—Lowell A. Larson

*Attorney, Agent, or Firm*—Ernst Kettelson

[57] ABSTRACT

An adjustable frame assembly to hold auto bodies of unit body construction for straightening of bent and damaged portions thereof. The frame is comprised of telescoping bar assemblies for each side and each end, including a tubular bar member and an insert bar member received therein movable inwardly and outwardly to adjust the frame both longitudinally and laterally to fit whatever auto the frame is to be used with. The frame has projections at each corner for anchor members to receive and bolt to the floor. As an alternative, eye or ring members are provided for connection of chains to anchor the frame in that manner. In that case, lock bolts are provided to hold the insert bar members in fixed position relative to their corresponding tubular bar members.

9 Claims, 10 Drawing Figures

FRAME TO HOLD AUTO BODIES FOR STRAIGHTENING

BACKGROUND OF THE INVENTION

This invention relates to the field of frames to hold auto bodies for straightening, and in particular to those for use with autos of unit body construction.

Prior art devices of this kind are expensive and complex. The present invention provides a comparatively inexpensive device for use with associated pulling equipment that is able to accomplish the same result that much more expensive ones are now used to accomplish.

The present invention comprises a frame for holding an auto body of unit body construction for straightening, which frame can be adjusted both longitudinally and laterally for use with autos of a wide variety of makes and sizes by providing side and end frame members which can be telescoped inwardly and outwardly.

The invention includes use of the frame with anchor members which hold it rigidly in place on the floor of an auto body shop, or in the alternative with chains anchored to anchor members to the front and back of the frame as well as to each side. The frame can also be used to straighten one side of an auto which has buckled underneath on one side by gripping the rocker panel pinch weld on that side, then placing a hydraulic cylinder between support posts at each end of the telescoping side member and spreading apart until the body portion has been straightened.

DESCRIPTION OF THE PREFERRED EMBODIMENT

Figure 1:
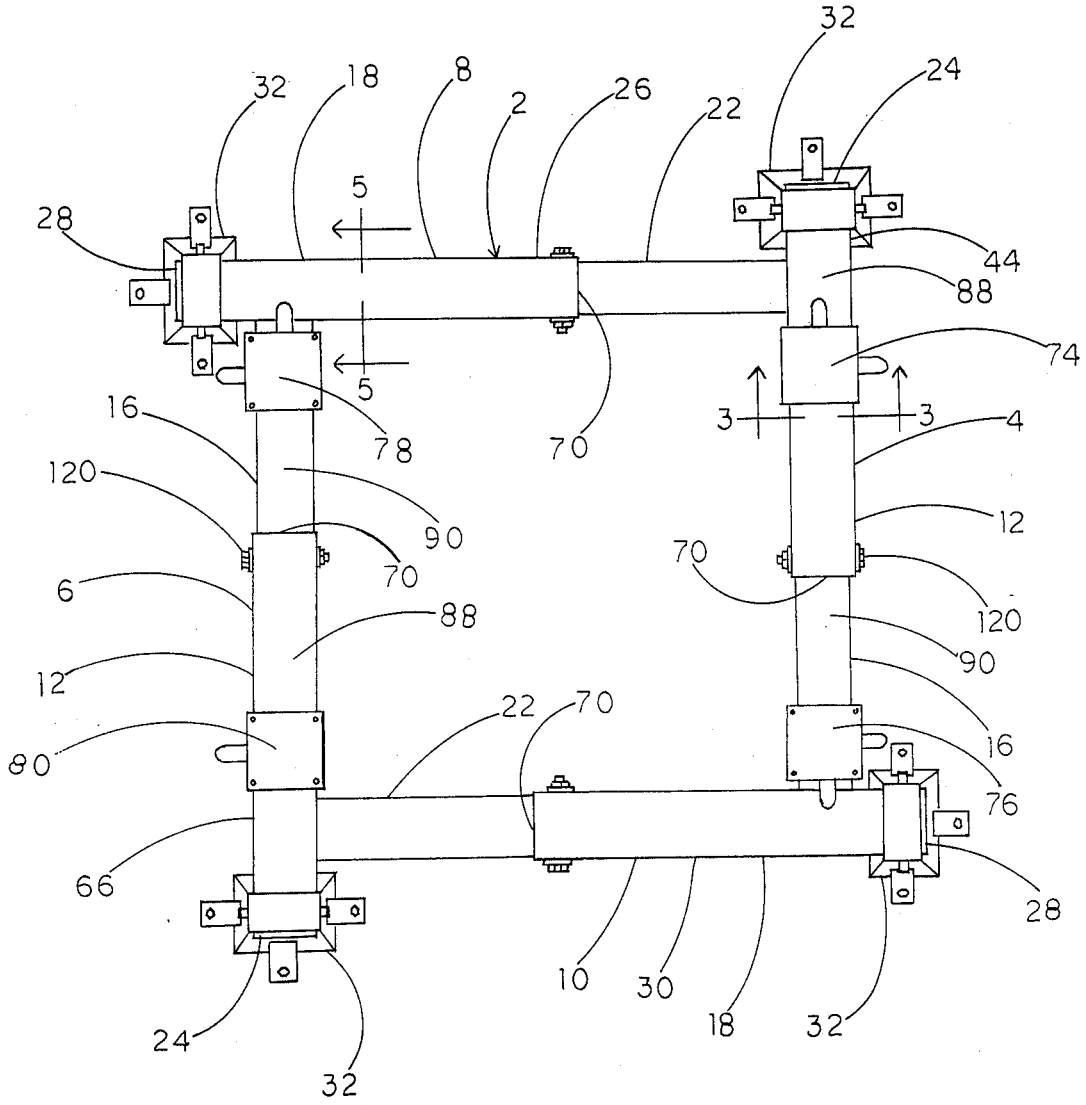
FIG. 1 is a plan view of the frame for straightening auto bodies in accordance with this invention.
Figure 2:
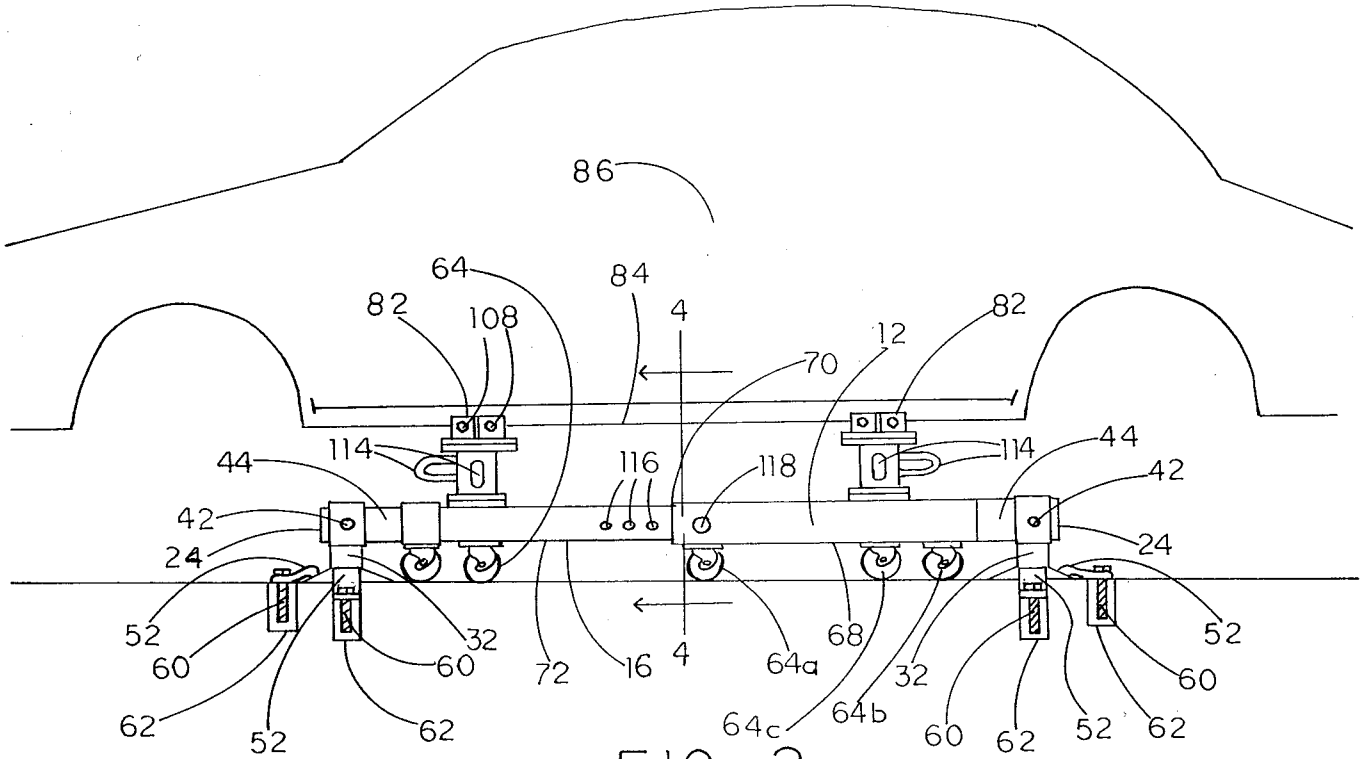
FIG. 2 is a side elevation view of the frame shown in FIG. 1, with an auto body shown gripped by jaw members mounted on the support stands thereof.
Figure 3:
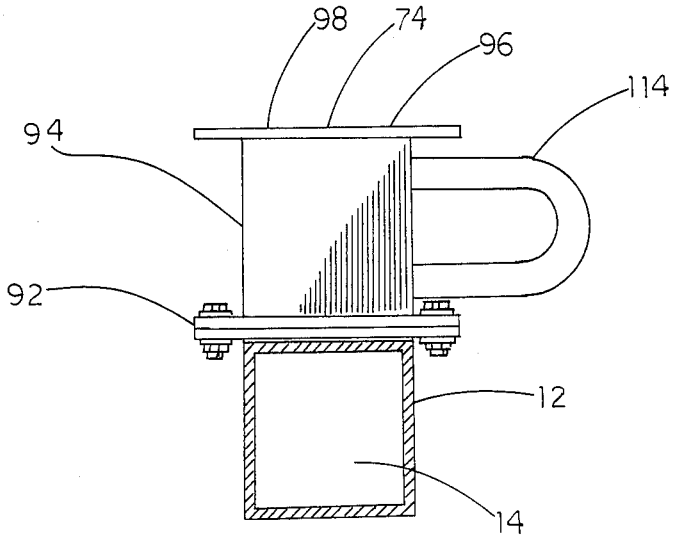
FIG. 3 is a section view taken on line 3—3 of FIG. 1.
Figure 4:
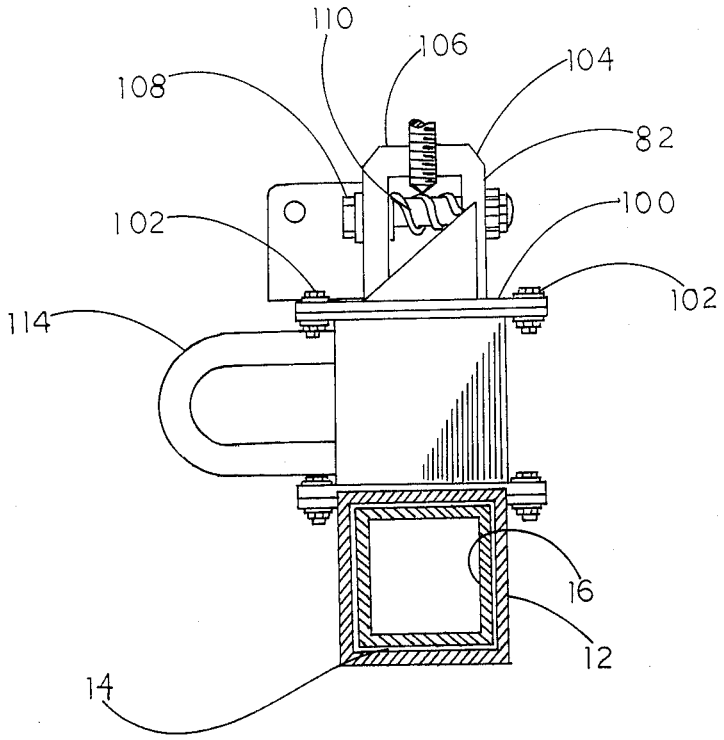
FIG. 4 is a section view taken on line 4—4 of FIG. 2.
Figure 5:
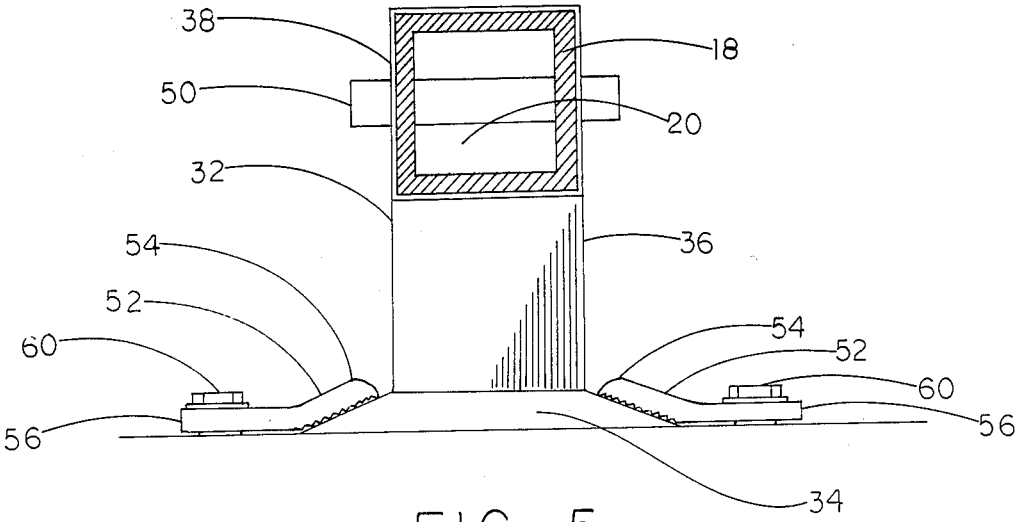
FIG. 5 is a section view taken on line 5—5 of FIG. 1.
Figure 6:
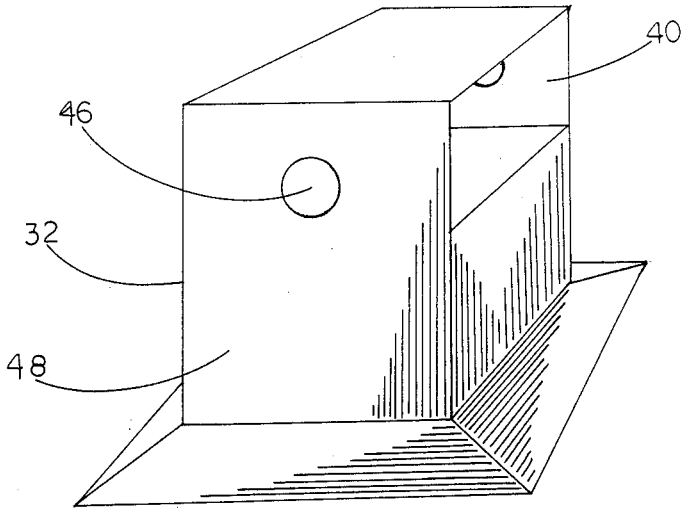
FIG. 6 is a perspective view of an anchor assembly for use with this invention.
Figure 7:
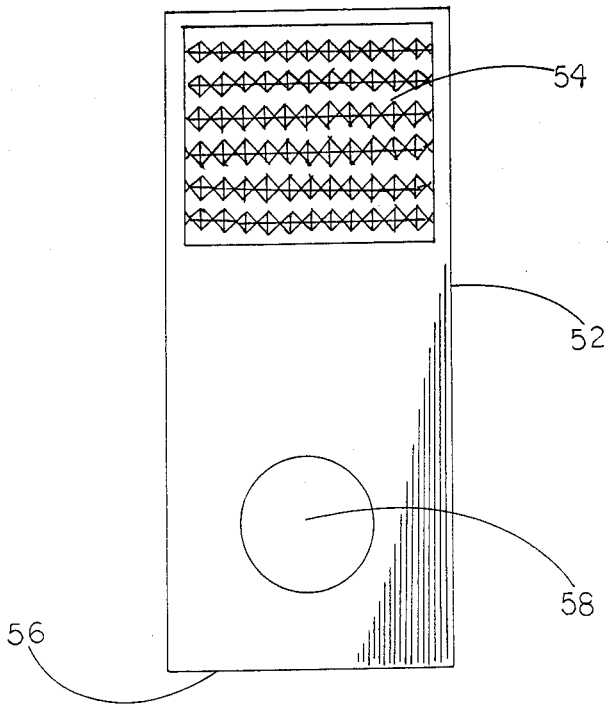
FIG. 7 is a plan view of a clamp for clamping the anchor assembly shown in FIG. 6 to the floor of an auto body shop.
Figure 8:
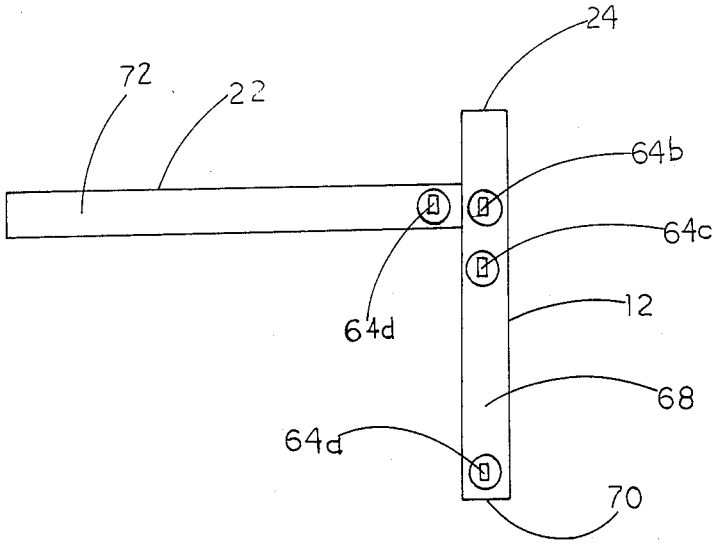
FIG. 8 is a plan view from the bottom of a tubular bar member and integrally joined insert bar member at substantially right angles to each other.
Figure 9:
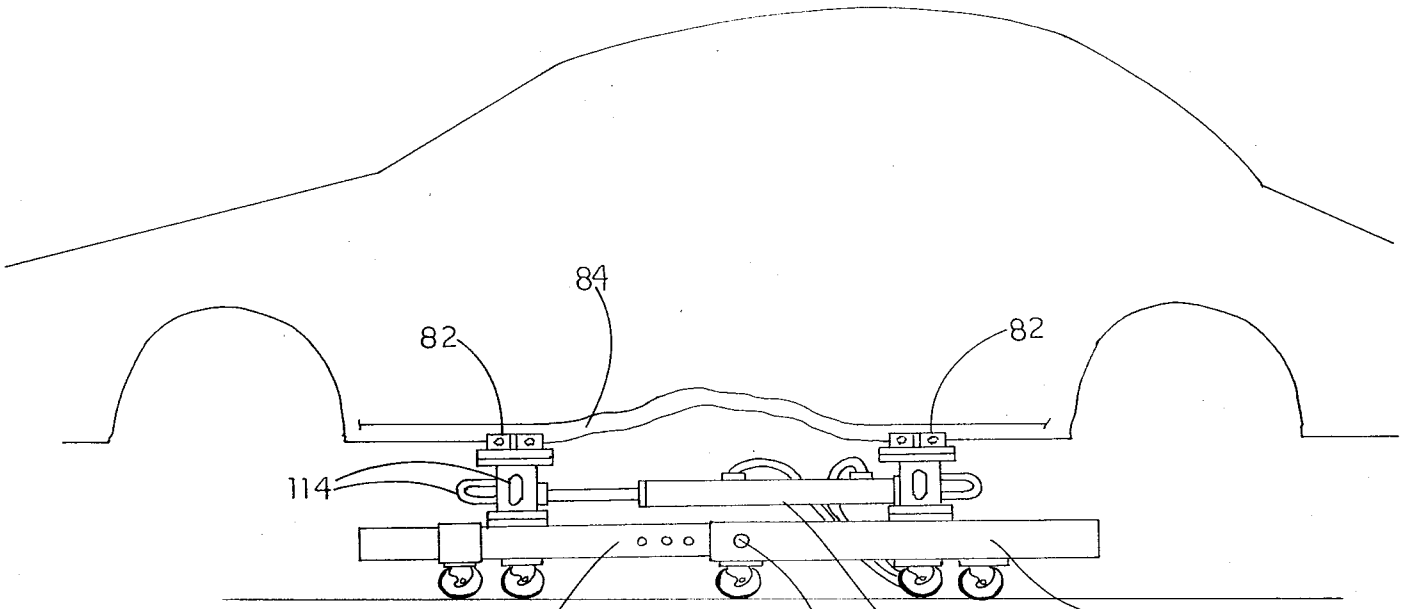
FIG. 9 is a side elevation view of an auto body having a buckled underside gripped and held by the frame in accordance with this invention showing a hydraulic cylinder in place to spread apart the support members and jaw members thereon until the underside has been straightened.
Figure 10:
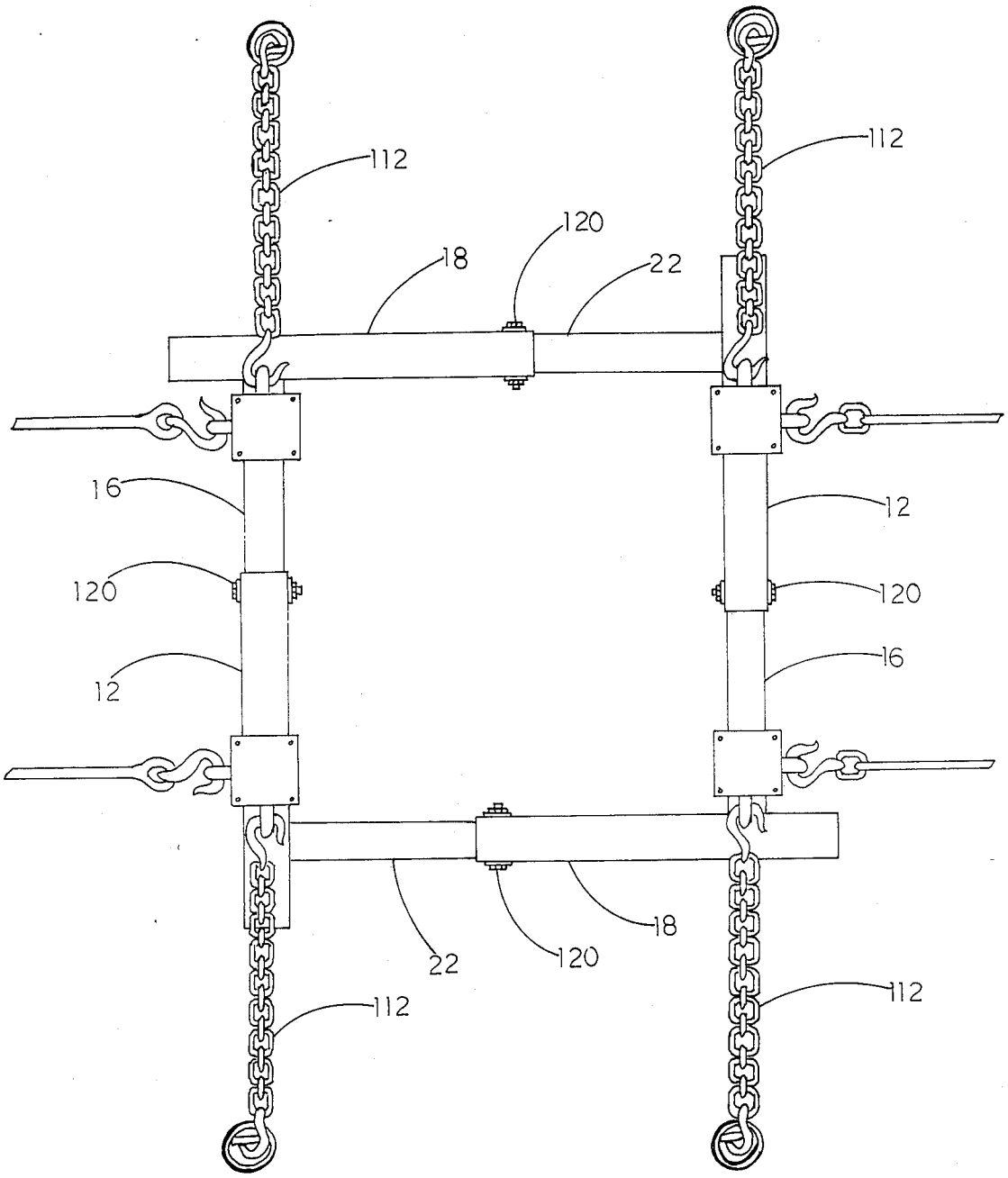
FIG. 10 is a top plan view of a frame in accordance with this invention showing an optional method of use, using chains to anchor the frame and hold it in place.

An adjustable bed for holding auto bodies of unit body construction in accordance with this invention, includes a frame 2 having a pair of spaced apart side members 4 and 6 connected at each end region by a pair of end members 8 and 10.

The side members 4 and 6, and the end members 8 and 10 are two part telescoping steel bar assemblies, whereby the frame 2 can be adjusted both longitudinally and laterally as to its length and its width.

Side members 4 and 6 each include an elongated tubular bar member 12 having a cavity 14 extending the length thereof. The tubular bar member 12 as shown and described herein is of generally square cross-section, but it could be of other cross-sectional configuration such as circular or ovular. Side members 4 and 6 also each include an insert bar member 16 having a cross-sectional configuration and dimension corresponding to that of the cavity 14 of tubular bar member 12 whereby insert bar member 16 is received in said cavity 14 for sliding movement inwardly and outwardly thereof to lengthen or shorten the longitudinal dimension of the frame 2.

End members 8 and 10 each include an elongated tubular bar member 18 having a cavity 20 extending the length thereof. The tubular bar member 18 as shown and described herein is of generally square cross-section, but it could be of other cross-sectional configuration such as circular or ovular. End members 8 and 10 also each include an insert bar member 22 having a cross-sectional configuration and dimension corresponding to that of the cavity 20 of tubular bar member 18 whereby insert bar member 22 is received in said cavity 20 for sliding movement inwardly and outwardly thereof to lengthen or shorten the lateral dimension of the frame 2.

Side member 4 includes a longitudinal projection 24 extending forwardly from the front end 26, and side member 6 includes a longitudinal projection 24 extending rearwardly from the rear end 30 thereof. Front end member 8 includes a lateral projection 28 extending outwardly from the left hand side of the frame 2 looking toward the front end 26, and rear end member 10 includes a lateral projection 28 extending outwardly from the right hand side of the frame 2 looking toward the front end 26. The longitudinal projections 24 and lateral proJections 28 are integrally formed with the respective portions of side members 4 and 6 and end members 8 and 10 from which they extend and with which they are axially aligned. The projections 24 and 28 also have the same cross-sectional configuration and dimension as the respective portions of side members 4 and 6 and end members 8 and 10 from which they extend and with which they are axially aligned.

Four anchor assemblies 32 are provided to receive the two longitudinal projections 24 and the two lateral projections 28, to hold them rigidly in place when the anchor assemblies 32 are themselves anchored to the floor of the body shop.

The anchor assemblies 32 include a base plate 34 to rest on the floor, an upwardly extending pedestal 36, and an integrally formed tubular collar 38 having a cavity 40 to receive a respective one of the projections 24 or 28. The cavity 40 of tubular collar 38 has a cross-sectional configuration and dimension corresponding to that of the projections 24 and 28.

The projections 24 and 28 each include apertures 42 through their side walls 44 which come into registration with apertures 46 through the side walls 48 of the anchor assemblies 32 when projections 24 and 28 of side members 4 and 6 and of end members 8 and 10 are received in said anchor assemblies 32. Anchor pins 50 are provided to extend through the apertures 42 and 46 to anchor the projections 24 and 28 and their respective side and end members to the anchor assemblies 32.

The anchor assemblies 32 are anchored to the floor of the body shop by clamps 52, which include a clamp end 54 to seat against and grip an edge of the base plate 34 of anchor assembly 32, and an anchor end 56 for bolting to the floor. The anchor end 56 includes an aperture 58 to receive an anchor bolt 60 therethrough, for threaded engagement with a threaded tap 62 seated in the floor of the body shop. A plurality of threaded taps 62 are provided in the floor of the body shop at spaced apart locations corresponding to the various lengths and widths of autos with which the present invention may be used and the location of the projections 24 and 28 of the end and side members when an auto is received and held on the frame 2.

The side members 4 and 6, and end members 8 and 10, are mounted on swivel rollers 64 whereby the frame 2 can be readily moved in any direction.

In the embodiment of the invention shown and described herein, the side members 4 and 6, and the end members 8 and 10, are constructed as follows.

The elongated tubular bar member 12 of each side member 4 and 6, is integrally formed with and connected to the insert bar member 22 of each end member 8 and 10 respectively, the insert bar member 22 extending at substantially a right angle to the tubular bar member 12 at the end thereof adjacent the projections 24 or 28.

The elongated tubular bar member 18 of each end member 8 and 10, is integrally formed with and connected to the insert bar member 16 of each side member 4 and 6, the insert bar member 16 extending at substantially a right angle to the tubular bar member 18 at the end thereof adjacent the projections 24 or 28.

In one modification of the invention, the side members 4 and 6, and the end members 8 and 10, are formed by four substantially identical right angle members 66, wherein the elongated tubular bar members 12 and 18 are substantially identical in longitudinal and cross-sectional dimension and configuration, and the insert bar members 22 and 16 integrally formed at right angles thereto respectively are also substantially identical in longitudinal and cross-sectional dimension and configuration.

The swivel rollers 64 are secured to the bottom wall 68 of the tubular bar members 12 and 18 as follows. One roller **64*a* is secured at the free end 70 of tubular bar members 12 and 18, one roller 64*b* is secured at the opposite end adjacent projection 24 or 28, and one roller 64*c* is secured at a point inwardly of the said opposite end a short distance, about four inches. A fourth roller 64*d* is secured to the bottom wall 72 of the insert bar members 16 and 22 a short distance from their respective junctions with respective tubular bar members 12 and 18**, about four inches from said junction.

Four auto support pedestals or stands 74, 76, 78 and 80 are positioned on the frame 2, extending upwardly therefrom at spaced apart locations, on each of which an auto body clamp 82 is bolted for gripping the longitudinally extending rocker panel pinch weld 84 of unit body construction autos, thereby holding the auto body 86 which is to be straightened securely in place on the adjustable frame 2. The support pedestals or stands are located on the frame 2 as follows.

Support stand 74 is secured to the top wall 88 of tubular bar member 12 of telescoping side member 4 at a location above swivel roller **64*b* near front end 26 of the frame 2. Support stand 76 is secured to the top wall 90 of insert bar member 16 of telescoping side member 4 at a location above swivel roller 64*d* thereof near the rear end 30 of the frame 2**.

Support stand 78 is secured to the top wall 90 of insert bar member 16 of telescoping side member 6 at a location above swivel roller **64*d* thereof, near the front end 26 of the frame 2, and support stand 80 is secured to the top wall 88 of tubular bar member 12 of telescoping side member 6 at a location above swivel roller 64*b* thereof, near the rear end 30 of the frame 2**.

The support stands 74, 76, 78 and 80 each include a base plate 92, a pedestal column 94 rising therefrom a relatively short distance of about six inches, and a horizontal platform 96 integrally formed at the top of the pedestal column 94, having a flat planar surface 98 to receive thereon a corresponding base plate 100 of the auto body clamp 82 mounted on each of the support stands.

The auto body clamps 82 are secured to the support stands by four bolts 102 extending through corresponding bolt holes in the platform 96 of the support stands and in the base plate 100 of the auto body clamps 82. The auto body clamps 82 each include an upwardly extending stationary jaw member 104 integrally formed and connected to the base plate 100, and a movable jaw member 106 movable between a clamping position and a release position relative to said stationary jaw member 104. The movable jaw member 106 is moved to the clamping position by turning a pair of bolts 108 in the tightening direction, and it is moved to the release position by turning bolts 108 in the loosening direction. A pair of compression springs 110 are mounted on the respective shanks of the pair of bolts 108 between the movable jaw member 106 and the stationary jaw member 104 to bias the movable jaw member 106 toward the release position away from stationary jaw member 104 when the bolts 108 are turned in the loosening direction.

To enable use of the invention in shops which do not have anchor assemblies 32 to bolt the frame projections 24 and 28 to the floor, the frame 2 may be secured and held in place by chains 112 connected at one end to the support stands 74, 76, 78 and 80 and at the other end to the cleat of an anchor post sunk into the floor of the body shop. For this purpose the support stands 74, 76, 78 and 80 are each provided with a pair of ring or eye members 114 integrally formed and connected to the side walls of the pedestal column 94, projecting outwardly therefrom and positioned radially ninety degrees apart. Thus support stand 74 near the front end 26 of the telescoping side member 4 is positioned to have the pair of ring or eye members 114 facing forwardly for one, and outwardly to the right for the other. Support stand 76 near the rear end 30 of side member 4 is positioned to have one of the eye members 114 facing rearwardly and the other outwardly to the right. Support stand 78 near the front end 26 of telescoping side member 6 is positioned to have the pair of ring or eye members 114 facing forwardly for one, and outwardly to the left for the other. Support stand 80 near the rear end 30 of side member 6 is positioned to have one of its eye members 114 facing rearwardly and the other facing outwardly to the left.

With the eye members 114 facing in the direction as described above, chains 112 can be secured to both sides of the frame as well as to both ends to anchor the frame both forwardly and rearwardly as well as on both sides.

As can be seen from the foregoing detailed description, the frame 2 can be adjusted both longitudinally and laterally by telescoping the two side members 4 and 6 and two end members 8 and 10 inwardly or outwardly as desired to position the auto body clamps 82 in line to receive the longitudinally extending rocker panel pinch weld 84 on each side of the auto body, both at the forward end region thereof and at the rearward end region thereof. When the frame 2 has been adjusted laterally and longitudinally and an auto body gripped thereon by the clamps 82, it may in certain applications be desirable to lock the telescoping side and end members in that particular position. For example, when chains are used to hold the frame in place by pulling forward on the front end, pulling rearward on the rear end, pulling to the left from the left side and to the right from the right side, it is necessary to lock the telescoping side and end members in place. For that purpose, a plurality of apertures 116 are provided throught the side walls of insert bar members 16 and 22, spaced apart longitudinally, for registration with apertures 118 through the side walls of tubular bar members 12 and 18 near the free ends 70 thereof as the insert bar members are telescoped inwardly or outwardly of the tubular bar members to the desired position. Lock bolts 120 are then inserted through the aligned apertures 116 and 118 to lock the frame 2 in such position.

When the frame 2 is bolted to the floor by anchor assemblies 32 receiving the frame projections 24 and 28 therein, the frame 2 is rigidly held in the desired position without the need for the lock bolts 120.

When the frame 2 has been secured to the floor of the body shop, with an auto gripped by the clamps 82 in position for being worked on, chains may then be connected to the parts of the auto body which are to be straightened, the other ends of the chains being connected to pulling devices. Pulling force is then applied to straighten the body part while the frame 2 holds the auto body in place. The pullers as such are conventional, and are not a part of this invention.

For cars which have the underside of their mid-section buckled or bent the frame 2 in accordance with this invention may be used to straighten such part as follows. The side of the car which is buckled is placed in the corresponding side of the frame 2 with one clamp 82 gripping the forward end of the rocker panel pinch weld and the clamp 82 at the rear gripping the rearward end thereof. A hydraulic cylinder 122 may then be positioned between the support stands with one end of the cylinder bearing against the support stand in front and the other end bearing against the support stand in back. Pressure is then applied to the cylinder to extend its piston thereby forcing the support stands apart. Lock bolts 120 are not in place so the telescoping side member is free to telescope outwardly as the support stands are spread apart, carrying with them the clamps 82 gripping the forward and rearward portions of the pinch weld. The support stands and clamps are spread apart by the hydraulic cylinder until the buckle or bend has been removed from the underside of the auto body. During this operation, the other side of the car is not gripped by the clamps 82 on that side of the frame.

I claim:

1. A frame for holding an auto body for straightening, comprising a first telescoping bar assembly for one side of said auto body, a second telescoping bar assembly for the opposite side of said auto body, a third telescoping bar assembly for the front portion of said frame connected between said first and second telescoping bar assemblies, a fourth telescoping bar assembly for the rear portion of said frame connected between said first and second telescoping assemblies, support means extending upwardly from said frame to support an auto body thereon, jaw means on said support means to grip and hold said auto body rigidly on said frame, and anchor means to anchor said frame against movement relative to the floor, said anchor means including base means to rest on said floor, upwardly extending support means extending upwardly from said base means to support said frame above said floor whereby an auto body received thereon is supported entirely above said floor, tubular frame receiving means to receive portions of said telescoping bar assemblies therethrough for sliding movement therein, and releasable securing means movable between a securing position and a releasing position to hold said portions of said telescoping bar assemblies against said sliding movement in said tubular frame receiving means when said releasable securing means is in said securing position.

2. A frame for holding an auto body for straightening as set forth in claim 1, wherein said first and second telescoping bar assemblies each include a single longitudinally extending tubular bar member and a single longitudinally extending insert bar member for the sides thereof, and said third and fourth telescoping bar assemblies each include a single laterally extending tubular bar member and a single laterally extending insert bar member for the respective front and rear portions thereof.

3. A frame for holding an auto body for straightening as set forth in claim 2, wherein said tubular bar member of said first telescoping bar assembly for one side and said insert bar member of said third telescoping bar assembly for one end are integrally joined and extend at substantially a right angle to each other, said tubular bar member of said second telescoping bar assembly for the opposite side and said insert bar member of said fourth telescoping bar assembly for the opposite end are integrally joined and extend at substantially a right angle to each other, said tubular bar member of said third telescoping bar assembly for said one end and said insert bar member of said second telescoping bar assembly for said opposite side are integrally joined and extend at substantially a right angle to each other, said tubular bar member of said fourth telescoping bar assembly for said opposite end and said insert bar member of said first telescoping bar assembly for said one side are integrally joined and extend at substantially a right angle to each other.

4. A frame for holding an auto body for straightening as set forth in claim 3 wherein each of said tubular bar members and their respective integrally Joined insert bar members are substantially identical.

5. A frame for holding an auto body for straightening as set forth in claim 3, wherein each of said tubular bar members and their respective integrally joined insert bar members which extend at substantially right angles to each other include a top wall, a bottom wall and a plurality of rollers mounted on said bottom wall, a first one of said rollers being mounted on said bottom wall adjacent the free end of said tubular bar member, a second one of said rollers being mounted on said bottom wall of said tubular bar member adjacent its junction with said insert bar member, a third one of said rollers being mounted on said bottom wall of said tubular bar member a preselected distance from said second one of said rollers in the direction toward said first one of said rollers, and a fourth one of said rollers being mounted on said bottom wall of said integrally joined insert bar member substantially the same preselected distance from said second one of said rollers in the direction toward the free end of said insert bar member, one of said integrally joined bar members including a support member extending upwardly from said top wall thereof to support a portion of an auto body on said frame at a desired location spaced apart from said junction of said integrally joined bar members, said preselected distance for location of said third one and said fourth one of said rollers being selected to substantially equal the distance said support member is spaced apart from said junction.

6. A frame for holding an auto body for straightening as set forth in claim 1, wherein said support means includes a first support pedestal on the right hand side of said frame at the front portion thereof, a second support pedestal on the left hand side of said frame at the front portion thereof, a third support pedestal on the right hand side of said frame at the rear portion thereof, and a fourth support pedestal on the left hand side of said frame at the rear portion thereof, said anchor means including a plurality of anchor assemblies, said frame being rectangular having four corners, a respective one of said anchor members being located adjacent each of said four corners of said frame.

7. A frame for holding an auto body for straightening as set forth in claim 4, wherein said jaw means includes a first jaw member mounted on said first support pedestal, a second jaw member mounted on said second support pedestal, a third jaw member mounted on said third support pedestal and a fourth jaw member mounted on said fourth support pedestal, said base means of said anchor means comprising a plurality of base plates, one for each of said anchor assemblies, said upwardly extending support means of said anchor means comprising a plurality of vertically extending support columns, one for each of said anchor assemblies, said support columns extending upwardly from respective ones of said base plates, said tubular frame receiving means of said anchor means comprising a plurality of tubular sleeve members, one for each of said anchor assemblies, said tubular sleeve members positioned on and above respective ones of said vertically extending support columns.

8. A frame for holding an auto body for straightening as set forth in claim 6, wherein said anchor means includes a first longitudinal eye member on said first support pedestal facing to the front thereof an a first lateral eye member thereon facing to the right side thereof, a second longitudinal eye member on said second support pedestal facing to the front thereof and a second lateral eye member thereon facing to the left side thereof, a third longitudinal eye member on said third support pedestal facing to the rear thereof and a third lateral eye member thereon facing to the right side thereof, and a fourth longitudinal eye member on said fourth support pedestal facing to the rear thereof and a fourth lateral eye member thereon facing to the left side thereof.

9. A frame for holding an auto body for straightening as set forth in claim 1, wherein said anchor means includes a first longitudinal projection toward the front of said first telescoping bar assembly, a second longitudinal projection toward the rear of said second telescoping bar assembly, a first lateral projection toward the left of said third telescoping bar assembly as one faces toward the front, a second lateral projection toward the right of said fourth telescoping bar assembly as one faces toward the front, a first anchor assembly to receive and anchor said first longitudinal projection to the floor, while supporting it above said floor, a second anchor assembly to receive and anchor said second longitudinal projection to the floor, while supporting it above said floor, a third anchor assembly to receive and anchor said first lateral projection to the floor while supporting it above said floor, and a fourth anchor assembly to receive and anchor said second lateral projection to the floor while supporting it above said floor.

* * * * *